US005598655A

United States Patent [19]

McGarrah

[11] Patent Number: 5,598,655

[45] Date of Patent: Feb. 4, 1997

[54] BEVERAGE VENDOR FRONT AND METHOD FOR CHANGEABLE GRAPHICS

[75] Inventor: Robert G. McGarrah, Brookfield, Conn.

[73] Assignee: Pepsico, Inc., Purchase, N.Y.

[21] Appl. No.: 309,719

[22] Filed: Sep. 21, 1994

[51] Int. Cl.[6] ..... G09F 7/02

[52] U.S. Cl. ..... 40/611; 40/594

[58] Field of Search ..... 40/611, 594, 618, 40/575

[56] References Cited

U.S. PATENT DOCUMENTS

| | | | |
|---|---|---|---|
| D. 290,269 | 6/1987 | McGarrah . | |
| D. 314,796 | 2/1991 | McGarrah . | |
| 4,741,119 | 5/1988 | Baryla | 40/594 |
| 4,940,622 | 7/1990 | Leavitt, Sr. et al. | 40/594 X |
| 4,992,131 | 2/1991 | Connell | 40/594 X |
| 5,255,968 | 10/1993 | Craven | 40/611 X |
| 5,465,774 | 11/1995 | Smith | 40/611 X |

FOREIGN PATENT DOCUMENTS

| | | | |
|---|---|---|---|
| 698584 | 10/1953 | United Kingdom | 40/594 |
| 2117547 | 10/1987 | United Kingdom | 40/594 |

*Primary Examiner*—Kenneth J. Dorner
*Assistant Examiner*—Cassandra Davis
*Attorney, Agent, or Firm*—Finnegan, Henderson, Farabow, Garrett & Dunner

[57] ABSTRACT

Apparatus for displaying and replacing product graphic sheets includes a clear display panel of a vending machine, a mechanism for controlling access to the reverse side of the display panel, a graphics frame permanently or semi-permanently affixed to the reverse side of the clear display panel to indicate a placement position for a product graphics sheet, and the product graphics sheet removably adhered by static cling and clinging to the reverse side of the clear display panel within the graphics frame. In a different embodiment the product graphics sheet is removably adhered by a tacky adhesive instead of by static cling. Further, a method allows different product graphic sheets to be exchangeably mounted within the frame quickly and easily by a service technician.

14 Claims, 3 Drawing Sheets

BEVERAGE VENDOR FRONT AND METHOD FOR CHANGEABLE GRAPHICS

BACKGROUND OF THE INVENTION

1. Field of the Invention

The present invention relates to a method and apparatus for displaying and changing advertising or marketing graphics at points of sale, such as vending machines, and particularly for displaying and changing advertising or marketing graphics on vending machine fronts such as beverage vending machine fronts.

2. Description of the Related Art

Product providers employing vending machines (hereinafter, "vendors") as a sales outlet experience increasing costs as a result of the need to change graphic images on the vendors to coincide with the introduction of new products, new logos, new advertising slogans, and package designs for existing products. For example, vendors, such as soft drink vendors, yield reliable service for seven to ten years. The front panel on those vendors is frequently used as a display board for presenting the product in some fashion and for communicating advertising or promotional messages (collectively, "product graphics") to promote sales of products. For example, marketing research shows that, for reasons involving appetite appeal and impulse purchasing, a soft drink product sells best from a vendor if a can of the product on ice is displayed in graphic form on the machine.

The limited versatility of fixed-graphic machines becomes apparent when a new brand of soft drink or a new can design is to be displayed on the vendor front. The front is typically a durable tough plastic that extends most of the height and width of the machine. The product graphics are typically screen-painted ("screened" or "silk-screened") onto a surface of the panel, such as the back surface if the plastic is otherwise clear. Replacing the product graphics may cost $75 to $150, including labor and other removal costs, as well as labor and other installation costs for the new product graphics. When adhesive attachment of sign face material is also used, labor and other costs are increased because of the problems of adhesive removal over any practical-size display area. If the plastic panel itself requires replacement, the cost is still greater.

Additionally, a limited number of products (usually 1 or 2) can be advantageously displayed (visible at a distance) at one time, even though the number of products in the vendor can be much greater. Many sales may be lost as consumers are disappointed by assuming the vendor does not contain a new product or another product not displayed.

It would be desirable to solve one or more of these problems.

SUMMARY OF THE INVENTION

According to the invention, it has been recognized that both problems can be solved by an apparatus and a method disclosed hereinafter. The apparatus for displaying and replacing product graphics includes a clear display panel, a mechanism for controlling access to the reverse side of the panel, and a graphics frame permanently or semi-permanently affixed to the display panel to indicate the placement position on the panel reverse side for a product graphics sheet. Importantly, the apparatus also includes a product graphics sheet removably adhered to the reverse side of the clear display panel within the graphics frame.

In the preferred embodiment, the product graphics sheet is removably adhered to the panel reverse side by static cling. As used herein, the term "static cling" means the phenomenon, regardless of physical origin, that causes a thin flexible sheet to adhere to a solid surface without an intervening adhesive medium. Specifically, the term excludes use of intervening media that are conventional adhesives. Moreover, static cling also excludes the relatively new adhesives, such as tacky adhesives (partial adhesives or reusable adhesives), that permit release of a bond between surfaces.

The use of static cling in the preferred embodiment makes possible simple, quickly changeable, and inexpensive product graphics. Frequent changes of product graphics are an asset rather than a liability because the full range of products in a vendor can be displayed in any rotation. Product graphics may be removed and changed to a new graphic design with ease of removal and installment and at low cost at the first opportunity of the service technician. The marketing needs for new product introductions and the communication of new advertising messages are easily met. Moreover, the product graphics are protected from vandalism.

In a less preferred embodiment, the product graphics sheet is removably adhered to the panel reverse side by a tacky adhesive.

According to a different aspect of the invention, a novel method for presenting product graphics is achieved. The method for displaying product graphics includes providing on a clear display panel a protected reverse-side display surface with a graphics frame thereon, providing controlled access to said display surface, and removably adhering the product graphics within said graphics frame on said display surface, preferably by static cling, but, alternatively, less preferably by a tacky adhesive.

Additional features and advantages of the invention will be set forth in part in the description which follows, and in part will be obvious from the description, or may be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate preferred embodiments of the apparatus and method according to the invention and, together with the description, serve to explain the principles of the invention.

DESCRIPTION OF THE PREFERRED EMBODIMENT

Figure 2:
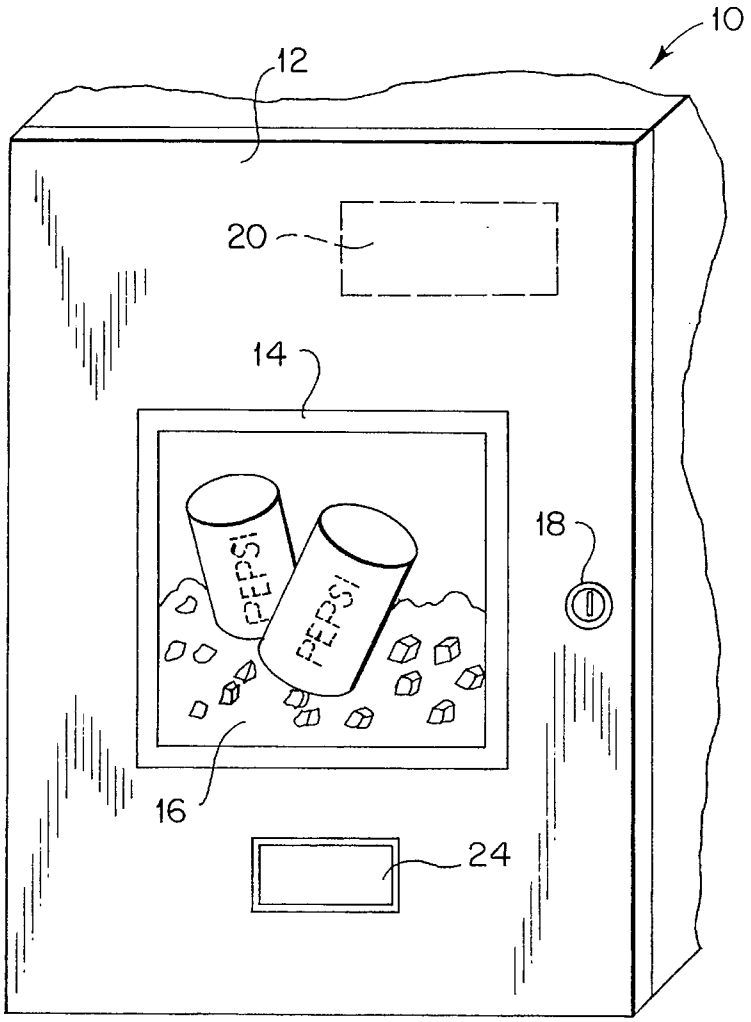
FIG. 2 is a front elevation of the panel of FIG. 1 with a product graphics sheet adhered by static cling.

Reference will now be made in detail to a preferred embodiment of the invention, an example of which is illustrated in the accompanying drawings. Wherever possible, the same reference numbers will be used throughout the drawings to refer to the same or like parts.

In accordance with the present invention, a clear display panel is provided having front and reverse sides and a graphics frame affixed to the panel to indicate a placement position on the panel reverse side for a product graphics sheet. Further, means are provided for controlling access to the reverse side of the display panel. A product graphics sheet is removably adhered to the reverse side of the display panel within the graphics frame by static cling.

In the illustrative embodiment of FIG. 1, a vending machine 10 (hereinafter called vendor 10) includes a clear front panel 12, for example, of LEXAN® (a trademark-of the General Electric Company) resin having a graphics frame 14. LEXAN® resin is a polycarbonate resin sheet material. The panel 12 includes a lock 18 at one edge and hinges (not shown) at the opposite edge to allow access to the interior of vendor 10 and access to the reverse side of panel 12. The edges of panel 12 are preferably mounted in a strong panel frame (not shown) of metal or heavy vinyl, the panel 12 and panel frame being securely bolted to a door of vendor 10 or securely joined to the hinges and to elements of lock 18.

Figure 1:
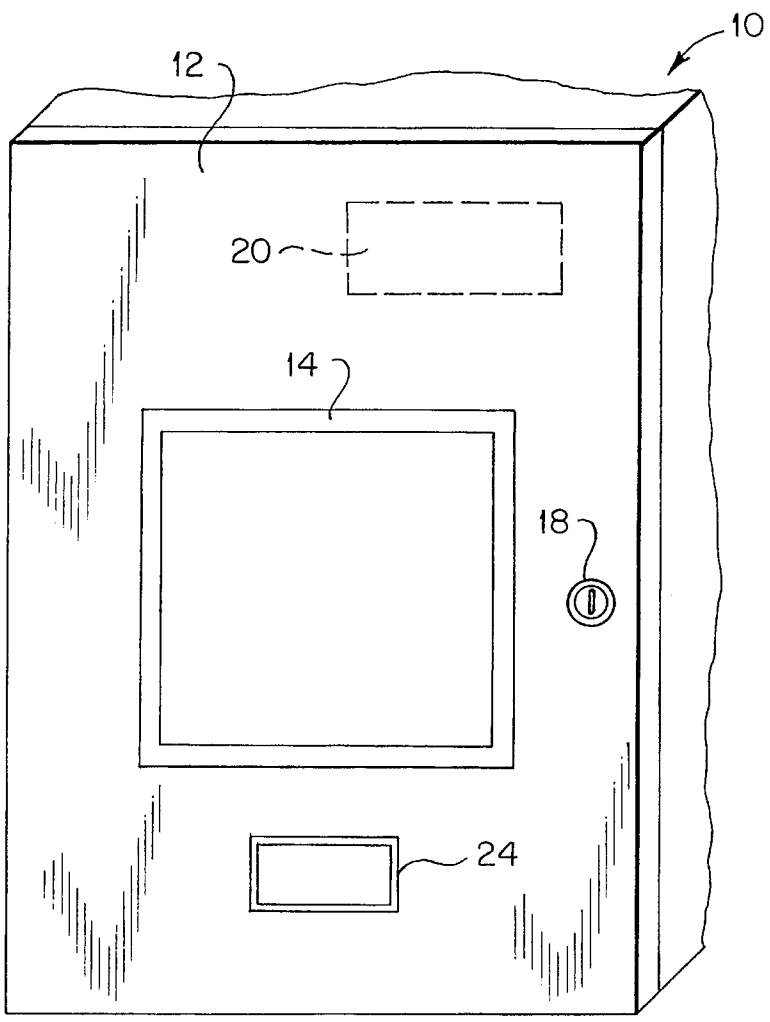
FIG. 1 is a front elevation of a display panel with graphics frame according to the principles of the invention.

At least the area within graphics frame 14 of display panel 12 is preferably illuminated from within vendor 10 by a back lighting mechanism 20 (shown schematically by dotted lines in FIG. 1). While a back lighted, clear display panel 12 is readily provided on the front of vendor 10, it could in principle be provided on any other lateral side of vendor 10. Steps would then be taken to ensure that the side of vendor 10 having display panel 12 is visible to the consuming public. The principles of the invention could also be applied to marketing graphics media other than vendors. Clear display panel 12 could alternatively be composed of other rigid materials such as other polycarbonate materials. It could also be glass, preferably impact resistant tempered safety glass.

Figure 4:
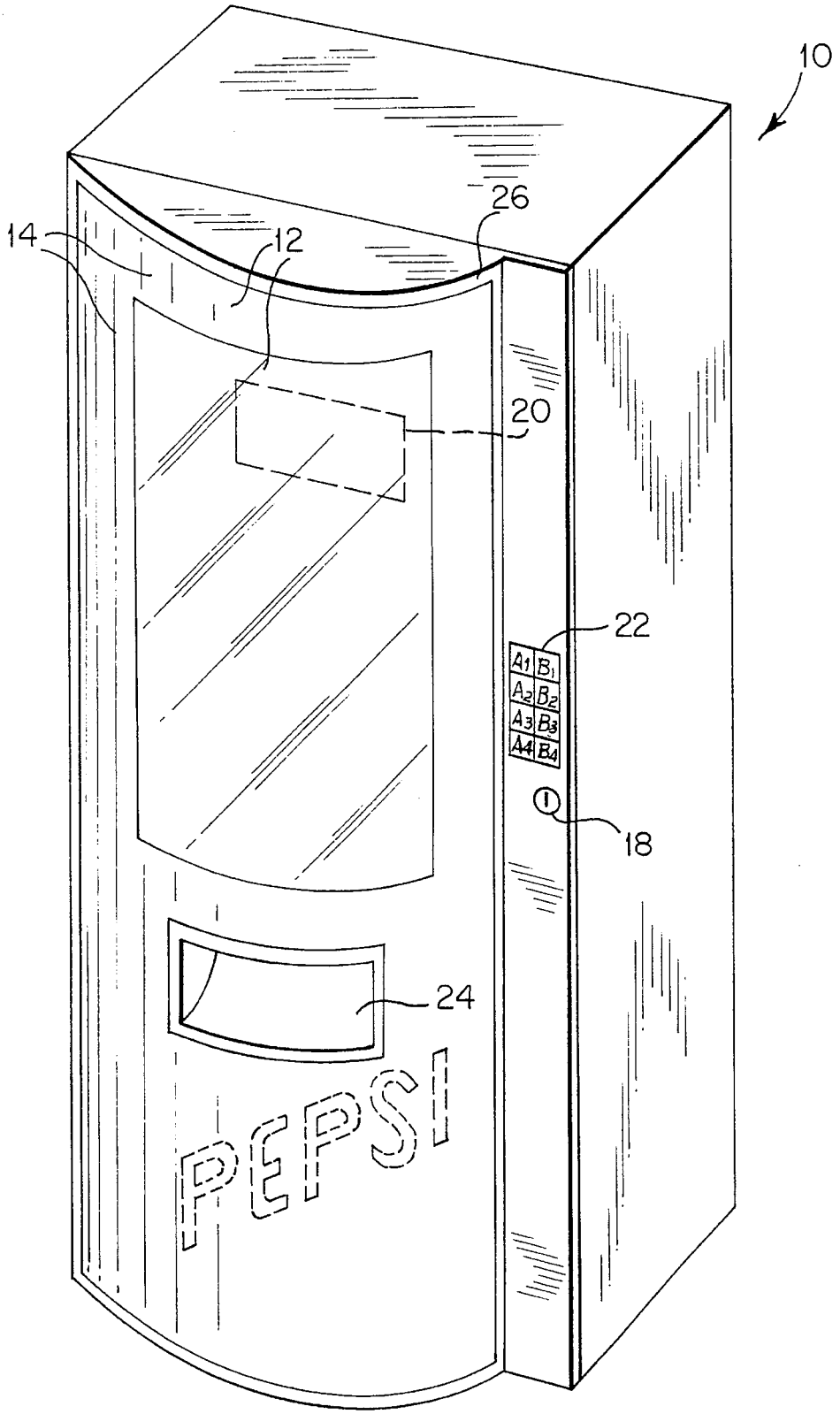
FIG. 4 is a front elevation of a preferred embodiment of the invention.

While frame 14 is shown with relatively limited width, it is frequently advantageous to allow it to extend all the way to the panel edge, in any selected respective direction, or in several or all directions, as shown in FIG. 4. Graphics frame 14 is preferably a painted frame screened on the reverse surface of clear display panel 12. In that form graphics frame 14 is sufficiently durable to withstand incidental contact by an agent's hands, for example, in changing the product graphics sheet within the frame, as well as to withstand low level vandalism (defacing such as by scratching).

In FIG. 2, clinging product graphics sheet 16 has been adhered by a static cling process to the area within the frame 14 on the reverse side of display panel 12. Illustratively, the edges of product graphics sheet 16 abut the inner edges of graphics frame 14 edge-to edge. Some overlap is feasible but is not necessary according to the preferred method of the invention, as described hereinafter. Product graphics sheet shows, for example, a can of soft drink in a bed of ice. In general, product graphics sheet 16 may be a flexible thin, tough sheet imprinted with logos, designs, or text; it is selected to be removed by pulling, without tearing, from the inner surface of display panel 12, once the latter is unlocked and opened. Thus, it may be easily exchanged with other flexible sheets to acquaint a consumer with the full range of products in vendor 10.

More specifically, product graphics sheet 16 may be a flexible polymer sheet, such as a vinyl sheet, bearing artwork and stored with a suitable wax-paper or foil-type sheet (not shown) protecting its front surface. For installation, the flexible polymer sheet 16 and the protecting sheet are separable by grasping each between a thumb and forefinger and pulling against the force of attraction between the sheets. Alternatively, product graphics sheet may be composed of an organic or composite material that resists tearing and possesses static cling properties.

Further, in the preferred embodiment of FIG. 4, clear display panel 12 is illustratively flexed outward (bowed) about a vertical axis by a corresponding conformation of the top and bottom portions of its mounting frame 26 and adjoining portions of the door of vendor 10. In this configuration, when clear display panel 12, is LEXAN®, the material exhibits enhanced resistance to frontal impact. Product graphics sheet 16, employing static cling, easily conforms to, and clings to, the interior of the curved clear display panel 12.

The method of the invention may be explained by reference to FIG. 3. As stated previously, the display apparatus provided in accordance with the present invention includes a clear display panel such as panel 12 with a protected reverse-side display surface having a graphics frame, such as frame 14. Broadly the method includes providing controlled access to the display surface and removably adhering the product graphics sheet 16 within the graphics frame by static cling.

Figure 3:
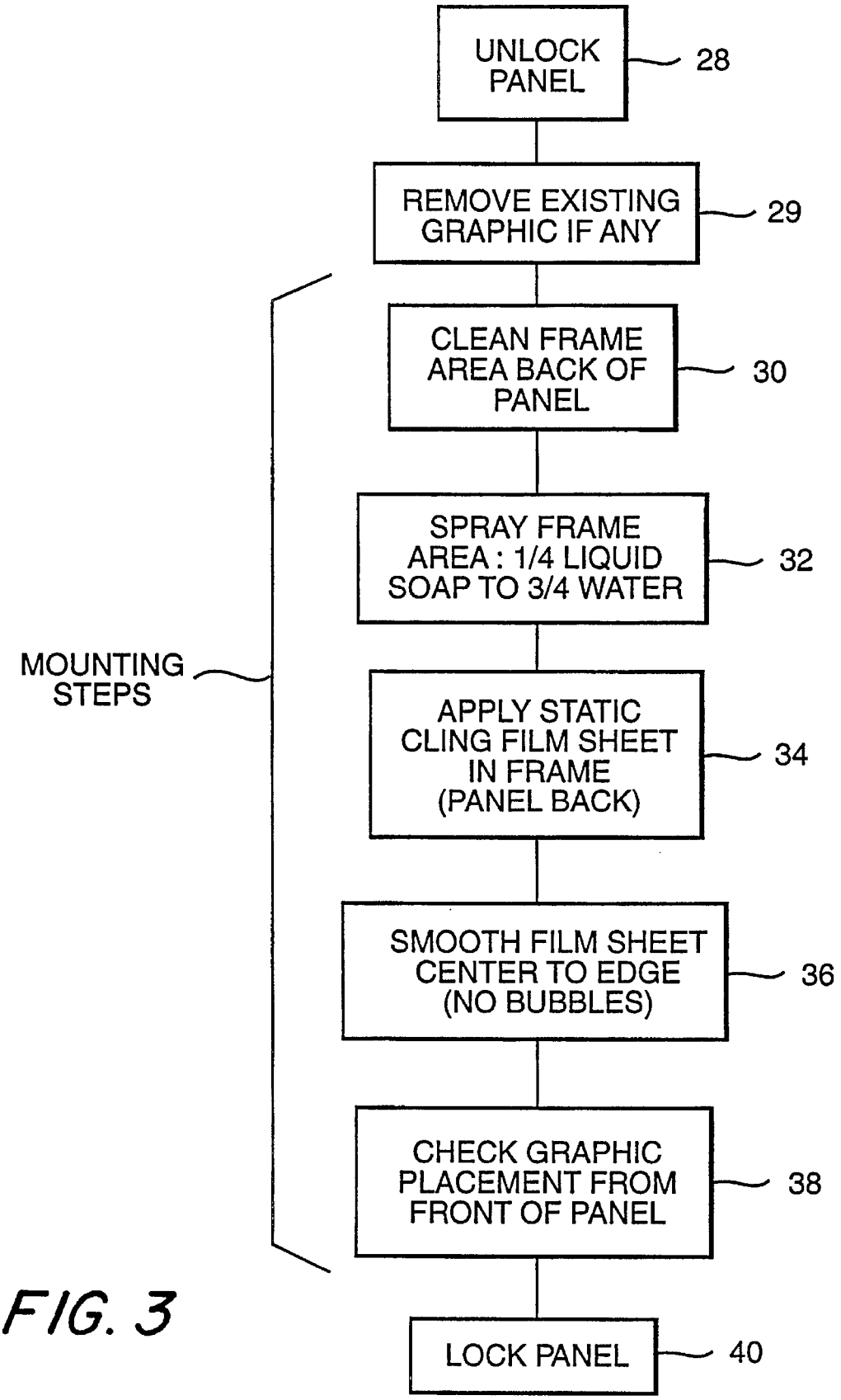
FIG. 3 is a flow chart of a detailed method according to the preferred embodiment of the invention.

In the detailed method depicted in FIG. 3, the first step 28 is to gain access to the display surface of the panel. In the disclosed embodiments, the display panel 12 with the entire access door of vendor 10 is unlocked from the frame of vendor 10.

The next step 29 prepares the vendor front for the following steps 30–38 of removably adhering the product graphics by static cling within the graphics frame on the reverse-side display surface of clear display panel 12. As embodied herein, after the display panel 12 is unlocked and opened, an existing product graphics sheet 16, if present, is removed by grasping a corner or an edge of the film sheet next to frame 14 and pulling it from the reverse surface of panel 12 against the force of the static cling.

The clear area within frame 14 is then cleaned and dried, or checked to assure that it is clean and dry, as indicated in step 30.

Next, static cling installation and adherence are provided for a new product graphics sheet 16, illustratively by spraying with a liquid solution, as indicated in step 32. As an example, for a vinyl product graphics sheet 16, liquid soap may be mixed with water to provide a ¼-to-¾ soap to water solution. The mixture proportions are typical and are not critical. In many instances, sufficient static cling will result even without the spraying step. However, in at least such instances, edge-to-edge adherence of product graphics sheet 16 within graphics frame 14 is made easier by lubricity provided by the solution. That is, product graphics sheet 16 may be slid enough on the panel reverse surface to achieve the desired position.

At step 34, the vinyl product graphics sheet 16 is applied to the reverse surface of panel 12 within frame 14, with its front surface contacting the reverse surface of panel 12. The vinyl product graphics sheet 16 is then smoothed into place, for example, by hand or by using a smoothing tool, such as a squeegee, with motions from center to edge to remove any residual moisture and all air bubbles, as depicted in step 36.

As shown at step 38, the placement of flexible film sheet 16 within frame 14 should be checked by viewing it from the front, and then panel 12 secured, at step 40, by locking it.

Some general considerations for both the apparatus and method of the invention may be taken into account. While not essential in all instances, it is certainly preferred that the advertising message on product graphics sheet 16 be viewable by a potential customer from a distance. Thus, in one variant, a panel 12 extends from the top of vendor 10 to the floor. Product selection buttons and even a product dispensing slot such as 22 and 24, respectively, in FIG. 4, as well as coin-handling and discharge openings and a cancel button (not shown), may be offset on vendor 10 to avoid interference with the display of product graphics sheet 16. Preferably, the product selection buttons are made square to minimize their area and still provide adequate product identification. Alternatively, any of or all of these buttons and openings may penetrate clear display panel 12 and have a sealed frame junction with clear display panel 12, as shown for product delivery slot 24.

As an example of a different embodiment of the apparatus of FIGS. 1 and 4 and the method of FIG. 4, the removable adhering function of the invention is provided by a partial adhesive or reusable adhesive of the type known as a "tacky" adhesive. An example of such an adhesive is that used on POST-IT® brand notes available from Minnesota Mining and Manufacturing Company (3M). POST-IT® is a registered trademark of 3M. Further, the tacky adhesive should be clear and not leave a residue on the display surface. Illustratively, the tacky adhesive is SPRAY MOUNT® artist's adhesive. SPRAY MOUNT® is a registered trademark of 3M. SPRAY MOUNT® artist's adhesive is available from 3M under catalog number 6065.

Product graphics sheet 16, according to this second embodiment of the invention, is illustratively a paper sheet bearing the advertising or marketing graphics. The tacky adhesive is applied in one of the following manners:

(1) over the entire front surface of product graphics sheet 16;

(2) on the edges of the front surface of product graphics sheet 16;

(3) over the entire portion of the reverse surface of panel 12 within the graphics frame 14; or (4) on the edges of the portion of the reverse surface of panel 12 within the graphics frame 14.

Further because a tacky adhesive is less tolerant of sliding contact than is a static cling contact mediated by a solution such as a soapy solution, the liquid application step 32 and smoothing step 36 may be eliminated. However, in such a case, it is desirable that product graphics sheet 16 in the second embodiment have an overlap of the inner edges of graphics frame 14 to accommodate slight off-center positioning.

It will be apparent to those skilled in the art that various modifications and variations can be made in the arrangement of the present invention and in the associated method without departing from the scope or spirit of the invention. As an example, product graphics frame 14, instead of being semi-permanently screened onto the reverse surface of panel 12 by the technique set out above, may be permanently etched into the reverse surface, or alternatively may itself be applied as one or more static cling elements to the reverse surface of panel 12.

It should also be apparent that the principles of both embodiments can be combined. For example, it may be advantageous to secure, by a tacky adhesive, one or more corners of a product graphics sheet that has been initially positioned using the method pertaining to static cling.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. Apparatus operatively connected to a product vending machine for product graphics display, comprising:

a clear display panel having front and reverse sides;

means for controlling access to the reverse side of the panel;

a graphics frame affixed to the panel on the panel reverse side; and a product graphics sheet removably adhered to the panel reverse side within the graphics frame, wherein the product graphics sheet is formed from a material capable of static cling and clings to the panel reverse side within the graphics frame.

2. The apparatus of claim 1, wherein the means for controlling access to the reverse side of the panel facilitates adhering and removal of the product graphics sheet and includes a lockable door for the vending machine, the clear display panel being mounted within the lockable door to be visible at an exterior surface thereof.

3. The apparatus of claim 1, wherein the frame is screened on the reverse side of the display panel.

4. The apparatus of claim 1, wherein the frame surrounds a major portion of the area of the reverse side of the clear display panel.

5. The apparatus of claim 1, wherein said clear display panel is composed of polycarbonate resin sheet material and said product graphics sheet is composed of vinyl.

6. A method for displaying product graphics in a product vending machine, comprising the steps of:

providing on a clear display panel in the product vending machine a protected reverse-side display surface and a graphics frame on the reverse-side display surface;

providing controlled access to said display surface; and removably adhering a flexible product graphics sheet to the reverse-side display surface within the graphics frame by static cling to the display surface.

7. The method of claim 6, further comprising the steps of:

removing the flexible product graphics sheet from within the graphics frame by gaining access to said display surface and pulling against the static cling; and removably adhering another flexible product graphics sheet to the display surface within the graphics frame by static cling.

8. The method of claim 7, wherein the clear display panel is secured to a vending machine that contains several products and further comprising the step of:

repeating the removing and the removably adhering steps to sequentially display a plurality of product graphic sheets corresponding to the several products.

9. The method of claim 6, wherein the removably adhering step includes the step of smoothing the flexible product graphics sheet against the reverse-side display surface of the clear display panel.

10. The method of claim 9, wherein said smoothing step is carried out with a smoothing tool.

11. The method of claim 6, wherein the removably adhering step further includes the step of coating the display surface with a liquid solution prior to applying the flexible product graphics sheet.

12. A method for displaying product graphics in a product vending machine, comprising the steps of:

providing on a clear display panel in the product vending machine a protected reverse-side display surface and a graphics frame on the reverse-side display surface;

providing controlled access to said reverse-side display surface in the product vending machine; and removably adhering a flexible product graphics sheet within the graphics frame in the product vending machine, including smoothing the flexible product graphics sheet to have a front surface of the flexible product graphics sheet clinging to the reverse-side display surface of the clear display panel by static cling, wherein the smoothing step is carried out by a smoothing tool.

13. A method for displaying product graphics in a product vending machine, comprising the steps of:

providing on a clear display panel in the product vending machine a protected reverse-side display surface and a graphics frame on the reverse-side display surface;

providing controlled access to said reverse-side display surface in the product vending machine;

removably adhering a flexible product graphics sheet within the graphics frame in the product vending machine, including smoothing the flexible product graphics sheet to have a front surface of the flexible product graphics sheet clinging to the reverse-side display surface of the clear display panel by static cling;

removing the flexible product graphics sheet from within the graphics frame by gaining access to the reverse-side display surface in the product vending machine and pulling against the static cling; and removably adhering another flexible product graphics sheet to the reverse-side display surface within said graphics frame in the product vending machine by static cling.

14. The method of claim 13, wherein the clear display panel is secured to the product vending machine that contains several products, and further comprising the step of:

repeating the removing and removably adhering steps to display, in sequence with the flexible product graphics sheet, at least one additional flexible product graphics sheet corresponding to at least one of the several products.

* * * * *